US007918045B2

(12) United States Patent
Riley

(10) Patent No.: US 7,918,045 B2
(45) Date of Patent: Apr. 5, 2011

(54) WRISTBAND WITH SLOTTED IDENTITY TAG

(75) Inventor: James M. Riley, St. Louis, MO (US)

(73) Assignee: Laser Band, LLC, St. Louis, MO (US)

( * ) Notice: Subject to any disclaimer, the term of this patent is extended or adjusted under 35 U.S.C. 154(b) by 495 days.

(21) Appl. No.: 11/456,928

(22) Filed: Jul. 12, 2006

(65) Prior Publication Data

US 2006/0218837 A1 Oct. 5, 2006

Related U.S. Application Data

(63) Continuation of application No. 10/870,500, filed on Jun. 17, 2004, now Pat. No. 7,520,077, and a continuation-in-part of application No. 11/374,251, filed on Mar. 13, 2006, now Pat. No. 7,325,347, and a continuation of application No. 10/283,777, filed on Oct. 30, 2002, now Pat. No. 7,017,293, and a continuation-in-part of application No. 10/256,758, filed on Sep. 27, 2002, now Pat. No. 7,047,682.

(51) Int. Cl.
*A44C 5/00* (2006.01)

(52) U.S. Cl. ..... 40/633; 283/75

(58) Field of Classification Search ..... D11/5
See application file for complete search history.

(56) References Cited

U.S. PATENT DOCUMENTS

| | | | |
|---|---|---|---|
| 230,455 | A | 7/1880 | Wilcox |
| 919,983 | A | 4/1909 | Walsh |
| 922,948 | A | 5/1909 | Portmore |
| 1,383,335 | A | 7/1921 | Penksa |
| 1,517,456 | A | 12/1924 | Pulliam |
| 2,054,227 | A | 9/1936 | Nichols |
| 2,073,280 | A | 3/1937 | Lederer |
| 2,553,676 | A | 5/1951 | Roos |
| 2,641,074 | A | 6/1953 | Richmond |
| 2,687,978 | A | 8/1954 | Vogt |

(Continued)

FOREIGN PATENT DOCUMENTS

DE 202009015077 U1 1/2010

(Continued)

OTHER PUBLICATIONS

Avery Dennison DuraCard™.

(Continued)

*Primary Examiner* — Joanne Silbermann
(74) *Attorney, Agent, or Firm* — Thompson Coburn LLP

(57) ABSTRACT

A cushioned wristband includes a carrier having a multi-layered band portion and a strap sewn to the back of the band portion of the carrier. The band has a surface with loop material and the strap has a surface of hook material, the hook and loop surfaces being intended to secure the band in place as it is wrapped about a patient's appendage. The strap is appropriately sized to insert through one or both of two cinch slots of a self-laminating hang tag which may be printed with patient information and separated from a sheetlet or page sized business form processed through a printer for imaging of patient information thereon. The band portion of the carrier includes a cushioned layer of soft foamy or spongy material for contacting a patient's skin to thereby substantially eliminate any possibility for abrasion, rash, or other irritation or injury to the patient through wearing of the wristband.

17 Claims, 5 Drawing Sheets

U.S. PATENT DOCUMENTS 3,153,869 A 10/1964 Twentier
3,197,899 A 8/1965 Twentier
3,402,808 A 9/1968 Yannuzzi
3,517,802 A * 6/1970 Petrie ..... 206/39.5
3,585,743 A 6/1971 Jeffers
3,660,916 A 5/1972 McDermott et al.
3,854,229 A 12/1974 Morgan
4,004,362 A 1/1977 Barbieri
4,078,324 A 3/1978 Wiebe
4,179,833 A 12/1979 Knodel
4,226,036 A 10/1980 Krug
4,233,715 A 11/1980 McDermott
4,370,370 A 1/1983 Iwata et al.
4,565,731 A 1/1986 Komatsu et al.
4,612,718 A 9/1986 Golub et al.
4,627,994 A 12/1986 Welsch
4,630,384 A 12/1986 Breen
4,682,431 A 7/1987 Kowalchuk
4,696,843 A 9/1987 Schmidt
4,783,917 A 11/1988 Smith et al.
4,829,604 A 5/1989 Allen et al.
4,854,610 A 8/1989 Kwiatek
4,855,277 A 8/1989 Walter
4,914,843 A 4/1990 DeWoskin
4,941,210 A 7/1990 Konucik
4,950,638 A 8/1990 Yuyama et al.
4,956,931 A 9/1990 Selke
4,978,144 A 12/1990 Schmidt et al.
4,991,337 A 2/1991 Solon
RE33,616 E 6/1991 Welsch
5,026,084 A 6/1991 Pasfield
5,045,426 A 9/1991 Maierson et al.
5,135,789 A 8/1992 Schmidt
5,222,823 A 6/1993 Conforti
5,227,004 A 7/1993 Belger
5,227,209 A 7/1993 Garland
5,283,969 A 2/1994 Weiss
5,311,689 A 5/1994 Lindsey
5,318,326 A 6/1994 Garrison
5,331,140 A 7/1994 Stephany
5,351,993 A 10/1994 Wright
5,370,420 A 12/1994 Khatib et al.
5,381,617 A 1/1995 Schwartztol et al.
5,383,686 A 1/1995 Laurash
5,395,667 A 3/1995 Ohno et al.
5,401,110 A 3/1995 Neeley
5,418,026 A 5/1995 Dronzek, Jr. et al.
5,427,416 A 6/1995 Birch
5,486,021 A 1/1996 Laurash
5,486,436 A 1/1996 Lakes
5,509,693 A 4/1996 Kohls
5,509,694 A 4/1996 Laurash et al.
5,518,787 A 5/1996 Konkol
5,524,934 A 6/1996 Schwan et al.
5,547,227 A 8/1996 Laurash et al.
5,560,657 A 10/1996 Morgan
5,581,924 A 12/1996 Peterson
5,586,788 A 12/1996 Laurash
5,595,404 A 1/1997 Skees
5,596,202 A 1/1997 Arakawa
5,598,970 A 2/1997 Mudry et al.
5,601,313 A 2/1997 Konkol et al.
5,630,627 A 5/1997 Stewart
5,637,369 A 6/1997 Stewart
5,648,143 A 7/1997 Mehta et al.
5,653,472 A 8/1997 Huddleston et al.
5,662,976 A 9/1997 Popat et al.
5,670,015 A 9/1997 Finestone et al.
5,687,903 A 11/1997 Akridge et al.
5,765,885 A 6/1998 Netto
5,842,722 A 12/1998 Carlson
5,877,742 A 3/1999 Klink
5,933,993 A 8/1999 Riley
5,984,363 A 11/1999 Dotson et al.
6,000,160 A 12/1999 Riley
6,006,460 A 12/1999 Blackmer
6,016,618 A 1/2000 Attia et al.
6,053,535 A 4/2000 Washburn et al.
6,055,756 A 5/2000 Aoki
6,058,639 A 5/2000 Tinklenberg et al.
6,067,739 A 5/2000 Riley
6,071,585 A 6/2000 Roth
6,092,321 A 7/2000 Cheng et al.
6,108,876 A * 8/2000 Hubbert ..... 24/265 WS
6,155,476 A 12/2000 Fabel
6,155,603 A 12/2000 Fox
6,159,570 A 12/2000 Ulrich et al.
6,199,730 B1 * 3/2001 Chisolm ..... 224/164
6,303,539 B1 10/2001 Kosarew
6,331,018 B1 12/2001 Roth et al.
6,343,819 B1 2/2002 Shiozaki
6,361,078 B1 3/2002 Chess
6,409,871 B1 6/2002 Washburn et al.
6,438,881 B1 8/2002 Riley
6,510,634 B1 1/2003 Riley
6,517,921 B2 2/2003 Ulrich et al.
6,611,962 B2 9/2003 Redwood et al.
6,641,048 B1 11/2003 Schintz et al.
6,685,228 B2 2/2004 Riley
6,748,687 B2 6/2004 Riley
6,782,648 B1 8/2004 Mosher, Jr.
6,807,680 B2 10/2004 Sloot
6,836,215 B1 12/2004 Laurash et al.
6,844,041 B2 1/2005 Squier et al.
6,863,311 B2 3/2005 Riley
7,017,293 B2 3/2006 Riley
7,017,294 B2 3/2006 Riley
7,047,682 B2 5/2006 Riley
7,197,842 B2 4/2007 Ali
7,222,448 B2 5/2007 Riley
7,240,446 B2 7/2007 Bekker
7,286,055 B2 10/2007 Girvin et al.
7,523,576 B1 4/2009 Petty
7,763,344 B2 7/2010 Riley et al.
7,779,569 B2 8/2010 Riley et al.
7,779,570 B2 8/2010 Riley
7,784,209 B2 8/2010 Greer
7,784,210 B2 8/2010 Riley et al.
7,818,908 B2 10/2010 Greer
7,823,310 B2 11/2010 Jain et al.
2002/0152928 A1 10/2002 Lawandy et al.
2002/0176973 A1 11/2002 Keiser
2003/0001381 A1 1/2003 Riley
2003/0003249 A1 1/2003 Benim et al.
2003/0011190 A1 1/2003 Ryan
2004/0068906 A1 4/2004 Riley
2004/0128892 A1 7/2004 Valenti
2004/0148836 A1 8/2004 Riley
2004/0244251 A1 12/2004 Riley
2005/0091896 A1 5/2005 Kotik et al.
2005/0108912 A1 5/2005 Bekker
2005/0279001 A1 12/2005 Riley
2005/0281989 A1 12/2005 Finger
2006/0230661 A1 10/2006 Bekker
2006/0236578 A1 10/2006 Saint et al.
2007/0089342 A1 4/2007 Jain et al.
2007/0120358 A1 5/2007 Waggoner et al.
2007/0257113 A1 11/2007 Davis et al.
2009/0094872 A1 4/2009 Ali et al.
2009/0277061 A1 11/2009 Jain et al.
2009/0282717 A1 11/2009 Jain et al.
2010/0071241 A1 3/2010 Jain et al.
2010/0253060 A1 10/2010 Riley et al.
2010/0281724 A1 11/2010 Greer et al.

FOREIGN PATENT DOCUMENTS

EP 1039431 9/2000
EP 1974603 A2 10/2008
FR 2806594 A 9/2001
GB 960859 6/1964
GB 2045718 11/1980
GB 2160492 12/1985
GB 2228915 A 9/1990
JP 63175913 A 11/1988
JP 5-61777 8/1993
JP 08-190350 7/1996
JP 08299035 A 11/1996

| | | | |
|---|---|---|---|
| JP | 3032299 | | 12/1996 |
| JP | 10-207374 | | 8/1998 |
| JP | 11015383 | A | 1/1999 |
| JP | 2001316921 | A | 11/2001 |
| JP | 2002117190 | A | 4/2002 |
| JP | 2002351321 | A | 12/2002 |
| JP | 2003066849 | | 3/2003 |
| JP | 2003157010 | | 5/2003 |
| JP | 2003164307 | | 6/2003 |
| JP | 2006039209 | | 2/2006 |
| WO | WO 96/12618 | | 5/1996 |
| WO | WO 98/23081 | | 5/1998 |
| WO | WO 99/18817 | | 4/1999 |
| WO | WO 02/39412 | | 5/2002 |
| WO | WO 03/003331 | | 1/2003 |
| WO | WO 2004/028826 | | 4/2004 |
| WO | WO 2006/007356 | | 6/2005 |
| WO | WO 2005/064574 | | 7/2005 |
| WO | 2007/021375 | | 2/2007 |
| WO | 2007/133906 | | 11/2007 |
| WO | 2008/079952 | A2 | 7/2008 |
| WO | 2009/137195 | | 11/2009 |
| WO | 2010129131 | | 11/2010 |

OTHER PUBLICATIONS

Avery® Laminated Identification Cards #5361.
Brochure entitled: "Color-Bar® Click Strip™" Label System; Smead Manufacturing Company; Date Unknown; Form No. SSS-CS-00.
Brochure entitled: "Color-Bar® Folders"; Smead Manufacturing Company; Date Unknown.
Brochure entitled: "Integrated Document Management Software"; Smead Manufacturing Company; Date Unknown; Form No. SLI-95.
Catalog entitled: "Reseller Catalog Number One"; Smead Software Solutions™; Date Unknown; Form No. SSS-RC1-00.
Sample of Standard Register Labels.
Standard Register, *P.S. Magazine*, Fall 1998, Dayton, Ohio.
Gretchen Berry, "Wrist Watch," *Advance for Healthcare Information Professionals*, Feb. 15, 1999.
Sample of Standard Register Label.
"Yes, Sir, That's My Baby!," *Material Management in Health Care*, Feb. 1999, vol. 8, No. 2, Health Forum, Inc.
Disaster Management Systems, Inc., Triage Tag, Copyright 1996, Pomona, California.
Maryland Department of Transportation, Maryland Emergency Medical Services, Triage Tag, Copyright MIEMMS 1999, Maryland.
Posey Movable I.D. Bracelet; downloaded from http:/www.posey.com/products/4648.html on Aug. 18, 2004.
ID Warehouse (http://web.archive.org/web/20050131235601/http://idwarehouse.com/) Jan. 31, 2005. p. 1: WB1908, Stock Vinyl Wristband.
International Search Report for PCT/US2009/031979 dated Mar. 9, 2009.
Office Action for U.S. Appl. No. 11/553,891 dated Mar. 19, 2009.
Office Action for AU Application 2006280450 dated Sep. 14, 2009.
Office Action for CN Application 200580019868.5 dated Sep. 4, 2009.
Office Action for U.S. Appl. No. 11/735,078 dated Nov. 17, 2009.
Office Action for U.S. Appl. No. 12/026,030 dated Oct. 8, 2009.
Office Action for U.S. Appl. No. 12/252,710 dated Oct. 15, 2009.
Office Action for U.S. Appl. No. 12/509,151 dated Nov. 13, 2009.
Office Action for U.S. Appl. No. 11/373,923 dated Jun. 1, 2009.
Office Action for U.S. Appl. No. 11/374,273 dated May 26, 2009.
Office Action for U.S. Appl. No. 11/562,114 dated May 6, 2009.
Office Action for U.S. Appl. No. 11/735,078 dated May 28, 2009.
Office Action for U.S. Appl. No. 11/763,615 dated May 6, 2009.
International Preliminary Report on Patentability (Chapter II) for PCT/US2009/039183 issued Apr. 20, 2010.
International Preliminary Report on Patentability (Chapter I) for PCT/US2008/064972 dated Dec. 1, 2009.
International Preliminary Report on Patentability (Chapter II) for PCT/US2009/031979 issued May 21, 2010.
International Search Report and Written Opinion for PCT/US2010/030361 dated Jul. 16, 2010.

* cited by examiner

WRISTBAND WITH SLOTTED IDENTITY TAG

CROSS-REFERENCE TO RELATED APPLICATIONS

This application is a continuation of Ser. No. 10/870,500 filed Jun. 17, 2004 and a continuation-in-part of Ser. No. 11/374,251 filed Mar. 13, 2006, which is a continuation of Ser. No. 10/283,777 filed Oct. 30, 2002 (now U.S. Pat. No. 7,017,293), which, in turn, is a continuation in-part of Ser. No. 10/256,758 (now U.S. Pat. No. 7,047,682).

BACKGROUND AND SUMMARY OF THE INVENTION

The inventor herein has previously invented multiple designs for self-laminating wristbands principally for use with patients in a medical or hospital setting. Examples of these may be found in his previously-issued U.S. Pat. Nos. 5,933,993; 6,000,160; 6,067,739; 6,438,881; 6,510,634; and 6,685,228 along with other patent applications pending for further designs, improvements, and inventive techniques and methods relating thereto, the disclosures of which are incorporated herein by reference. Included among these various inventions and designs are self-laminating wristbands intended for use with newborn babies including those delivered prematurely. As is well known, these babies and especially premature babies have extremely sensitive skin in many instances so that any wristband or other object placed around the baby's wrist or ankle must carefully allow for that sensitivity. Furthermore, babies are well known to move their arms and legs in a herky-jerky or flailing fashion, rub their eyes, and otherwise move about as they experience the new world that they have entered. In many instances, these newborn babies can become agitated and cry which can have a tendency to accentuate or intensify their arm and leg movements. Of course, as their hands, arms and legs move, they come in contact with other sensitive areas, such as, for example, their face, which could in some instances become scratched and in rare instances even injure the baby.

The inventor's previous designs include wristbands intended for these smaller babies including babies which might even be in intensive care and various features are provided to greatly minimize any possibility of discomfort, rash, or other injury to occur. Nevertheless, despite the great commercial success and widespread adoption and use of the inventor's wristband inventions, which have provided a significantly safer wristband for use with these babies, the inventor has continued his efforts to improve upon these designs even further so as to completely eliminate even the slightest possible chance of irritation or injury to the baby.

As a result of his continuing efforts, the inventor herein has succeeded in designing and developing a cushioned wristband which makes it virtually impossible for a baby who wears this wristband to experience a rash, discomfort, or even any injury as a result of the baby's boisterous conduct. In simple terms, this latest invention of a cushioned wristband includes a cushioned carrier for extending around the baby's wrist or ankle with a fastening strap preferably sewn to and extending from one side thereof. The strap preferably has one surface covered with Velcro™ hook-type fastener material while the carrier has a surface covered with Velcro™ loop material. The opposite surface of the carrier which comes into contact with the baby's skin is preferably any hypoallergenic, soft, cushioning material. The strap is preferably sized to thread through a self-laminating tag which may be processed through a laser printer and is similar in construction to many of the inventor's previous wristband designs. In essence, this self-laminating tag preferably comprises an imaging area of face stock material and an underlying self-laminating portion approximately twice the size of the imaging area with cinch slots preferably positioned in the lamination and preferably on either side of the imaging area. In use, the tag may be processed through a laser printer for printing with the patient's name, doctor's name, a barcode identifier, date of admission, and any other information as desired. The tag may then be separated from a sheetlet sized or page sized or other conveniently sized business form, the lamination folded over to self laminate the tag, and then applied to the carrier by inserting the strap through one or both of the cinch slots. Once fully assembled, the wristband may then be wrapped around the baby's wrist and the strap affixed to the back of the carrier by joining the hook and loop material of a Velcro™ fastener to thus secure the wristband to the baby. Preferably, the wristband is sized to allow for the cushioning material to wrap entirely around the baby's wrist, ankle, etc., and preferably overlap so that just the cushioning material contacts the baby's skin.

A somewhat similar prior art device is shown in FIG. 1. It comprises a wristband 100P made of cushioning material 102P with a backing of Velcro™ loop material 104P, with a short strap 106P sewn to one side thereof and having a Velcro™ hook material 108P arranged for securing the wristband. Sewn on the back of the wristband is a panel 108P to which a patient label 112P may be adhered. This patient label 112P may be provided as part of another form and printed such as by processing through a laser printer. It is noted that the patient label is exposed and not laminated, thereby requiring it to be made of a resilient material such as a vinyl or other durable material to withstand the moisture, body fluids and other abuse it will receive. Furthermore, there is no positive or mechanical attachment of the patient label to the wristband so that as it becomes worn and abused, the patient label is likely to become illegible or even detach which could lead to failure of the wristband in its essential purpose of reliably identifying the baby. With the wristband of the present invention, the cinch slots provide a positive mechanical attachment of a laminated patient label which makes it virtually impossible for it to become illegible or detached, thereby providing dramatically improved performance. The prior art patient label is not conveniently removed for refreshing the patient label with a new one, and instead it is thought that a new patient label would need to be adhered over the top of the existing patient label. This construction leads to attachment of a second patient label in a manner less secure than the original, unless extreme care is taken to prepare the panel for receiving the new patient label which is unlikely to happen in the hospital environment. Nurses have better things to do with their time than clean and prepare surfaces for receiving a new patient label. With the present invention, refreshment of a patient label is rarely necessary, and if necessary, can be achieved in a few steps by removing the wristband, sliding off the old patient label and sliding on the new patient label, and then replacing the wristband back on the baby. No cleaning of a surface, or peeling of the old label, is required. Furthermore, the replacement patient label is secured just as well as the original patient label. The present invention thus represents a dramatic step forward over this prior art construction.

There are many new features and advantages provided by the present invention. Some of these include the following. The self-laminating tag may be conveniently provided on a sheetlet or full-page size form for convenient processing through a laser printer at the time of admission along with other forms including other wristbands and labels as may be later used for the baby. Thus, the advantages as noted in the inventor's prior patents are carried forward with this invention in that regard. The self-laminating tag may be firmly secured either loosely or closely about the baby's wrist or ankle with only a cushioning material contacting the baby's skin to thereby provide reliable identification with a durable tag yet without any discomfort to the baby. The carrier is adjustable as it can be wrapped around itself to provide a variable length so that it may be used with babies of different size or age. In other words, the wristband carrier is sized and arranged with its hook and loop fastener to be adjustable in length and fit either loosely or tightly to the baby's appendage. The hang tag may be attached with either one or both of the cinch slots, as desired. If attached with a single cinch slot, the tag in essence is free to move with respect to the wristband and thereby be more readily accessible and remain flat for easier bar code scanning. If attached with the strap extending through both slots, the tag may be secured more tightly against the carrier, less subject to inadvertent detachment, and less likely to be inadvertently brought into contact with the baby. The wristband is relatively inexpensive yet durable and flexible in that, should a tag be desired to be changed as a result of heavy abuse, it may be conveniently done without reprocessing in many instances as additional tags may be conveniently printed at the time of admission. By being self laminating, the tag is protected from the various bodily fluids likely for it to come in contact with as the baby is fed or administered medicine orally, the baby drools, and the baby otherwise performs its bodily functions. As the hang tag is detachable, the carrier may be reused as desired or in shortage or emergency situations thereby making the entire wristband system more flexible. Indeed, the carrier may itself be washed in that same regard. The hang tag may be provided as part of a larger assemblage of wristband forms such that a single set of forms may be preprinted and available for usage as the baby's stay progresses and even to accommodate those relatively few occasions when the baby is kept for an extended stay.

While the principal advantages and features of the invention have been briefly described above, a more thorough understanding and appreciation for the invention and its advantages may be obtained by referring to the drawings and description of the preferred embodiment which follow.

DETAILED DESCRIPTION OF THE PREFERRED EMBODIMENT

Figure 2:
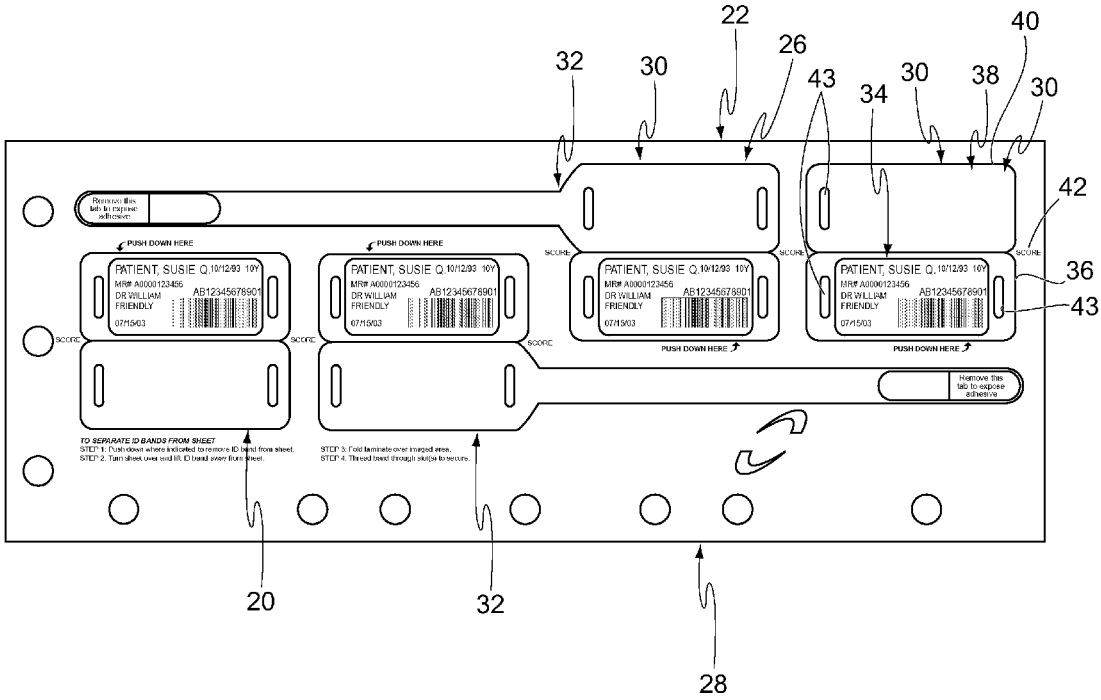
FIG. 2 is a top view of a sheetlet sized business form having a pair a self-laminating wristbands and a pair of self-laminating hang tags for use with the cushioned carrier as shown in FIG. 4.
Figure 3:
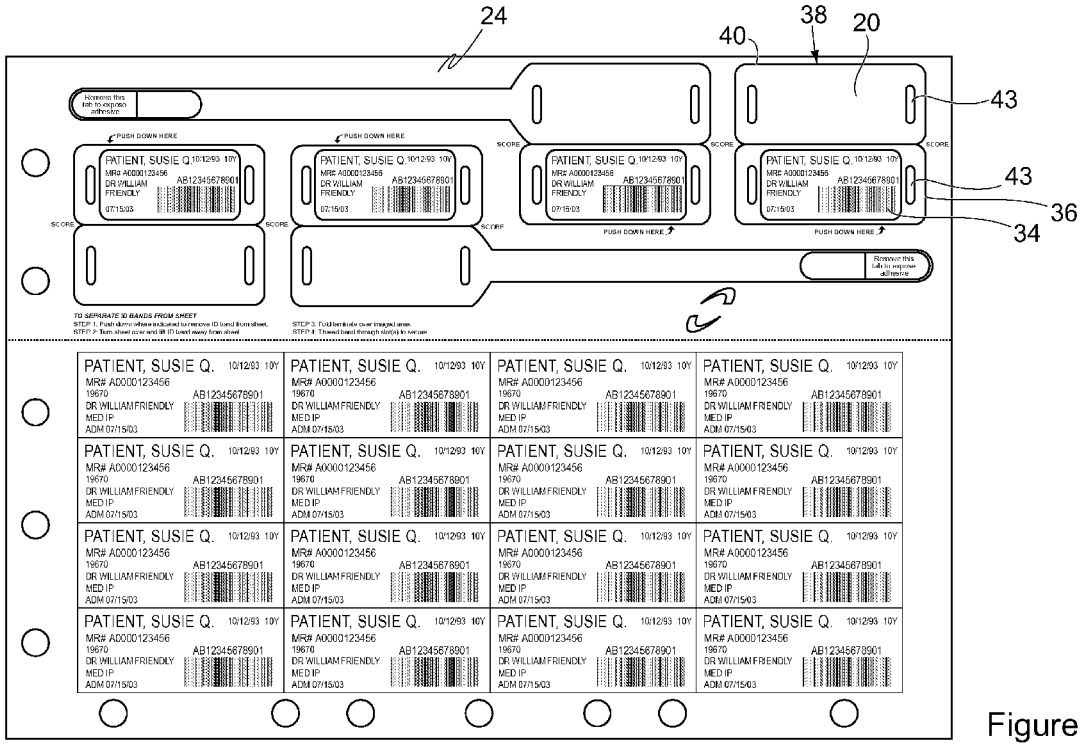
FIG. 3 is a top view of a full-page sized "combo" form having an upper portion containing a pair of self-laminating wristbands as well as a pair of self-laminating hang tags and a bottom portion having a matrix of printable self-adhesive labels.

As shown in FIGS. 2 and 3, the self-laminating hang tag 20 is provided as part of a multi-web business form shown as a sheetlet 22 in FIG. 2 or a page sized combination form 24 as shown in FIG. 3. The sheetlet 22 is approximately envelope sized for convenient processing through a laser printer, as is known in the art and as explained in the inventor's prior patents mentioned above. The sheetlet 22 is generally comprised of two plies, an upper face ply 26 joined to an underlying laminate ply 28, the self-laminating portions of which are shown in outline 30 on the sheetlet 22. A pair of hang tags 20 as well as a pair of self-laminating wristbands 32 are conveniently sized to fit within the confines of the sheetlet 22. Of particular interest for purposes of the present invention are the hang tags 20. Each of these include an imaging area 34 defined by a die cut 36 in the face stock layer 26 and an underlying laminating portion 38 defined by a die cut 40 in the laminate layer 28. A pair of cinch slots 43 are preferably provided in the laminating portion 34 and straddling the imaging area 34. These cinch slots are used to attach the hang tag 20 to the carrier 44, as is explained below in greater detail. As shown in FIGS. 2 and 3, the cinch slots 43 may be approximately 7/16 inches long by approximately 1/16 inches wide and spaced approximately 1¾ inches apart, or otherwise appropriately sized to allow for the hang tag 20 to be slidingly attached, as explained below. More particularly, the inventor contemplates that the cinch slots 43 should be preferably sized so as to minimize the possibility for the hang tag 20 to shift once the wristband has been applied to the baby. The self-laminating hang tag 20 is conveniently separated from the sheetlet 22 and the lamination portion 38 is folded about a score line 42 to completely encapsulate the imaging area 34. Of course, the imaging area 34 may be processed through a laser printer and printed with patient information upon admittance of the patient or, as with the case of a baby, birth of the baby. In addition to being provided in sheetlet 22 form, the wristbands 32 and hang tags 20 may also be provided as part of a page sized combo form 24 as shown in FIG. 3. The construction of the combo form 24 is explained in greater detail in one or more of the inventor's prior patents as mentioned above.

As shown in FIGS. 2 & 3, the wristband 32 may have a strap that is longer than its corresponding band or body portion.

Figure 1:
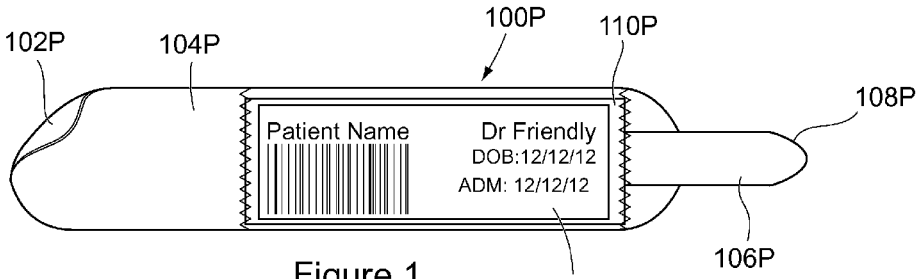
Figure 1 PRIOR ART
FIG. 1 is a plan view of a prior art wristband and label having a cushioning material carrier.
Figure 4:
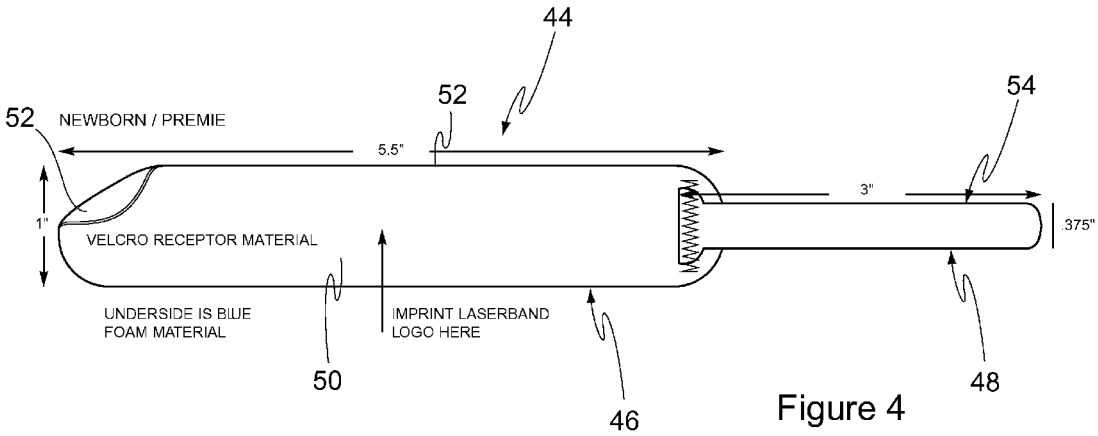
FIG. 4 is a top view of the cushioned carrier depicting the Velcro™ strap sewn to one side thereof for attachment of the self-laminating hang tags depicted in FIGS. 2 and 3.

The carrier 44 is shown in FIG. 4. It includes a band portion 46 and a strap portion 48. The band portion 46 is of multilayer construction with a top layer 50 of the "loop half" of a Velcro™ fastener material and a bottom layer 52 of a cushioned material which is preferably any soft foam or sponge-like material which may also be of surgical grade. The Velcro™ strap 48 has a lower surface 54 comprised of the "hook half" of a Velcro™ fastener such that as the carrier 44 is wrapped around a baby's wrist, the Velcro™ hook surface 54 may be brought to overlie the Velcro™ loop surface and attach the two ends of the carrier 44 and complete the wristband.

As shown in the preferred embodiment, the strap portion may be preferably sewn on to the end of the carrier or band portion 46 and be approximately 3 inches long by ⅜ inches wide. The hang tag cinch slots 43 are sized appropriately to receive and pass the strap portion 48 therethrough and allow an end of the strap portion 48 to extend beyond the second cinch slot 43 for exposure to the loop portion 50.

Figure 5:
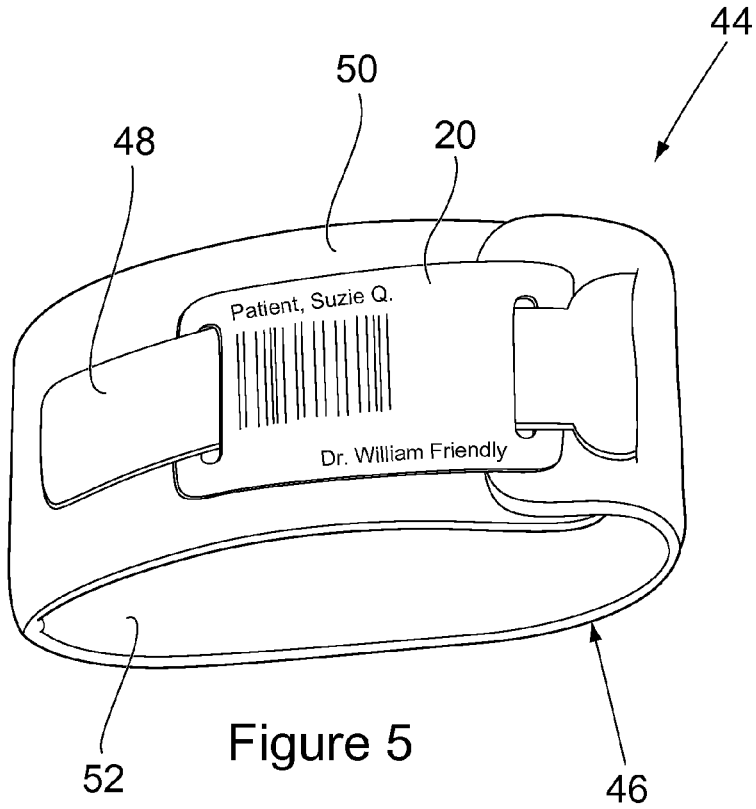
FIG. 5 is a perspective view of an assembled wristband with the strap threaded through both of two cinch slots.
Figure 6:
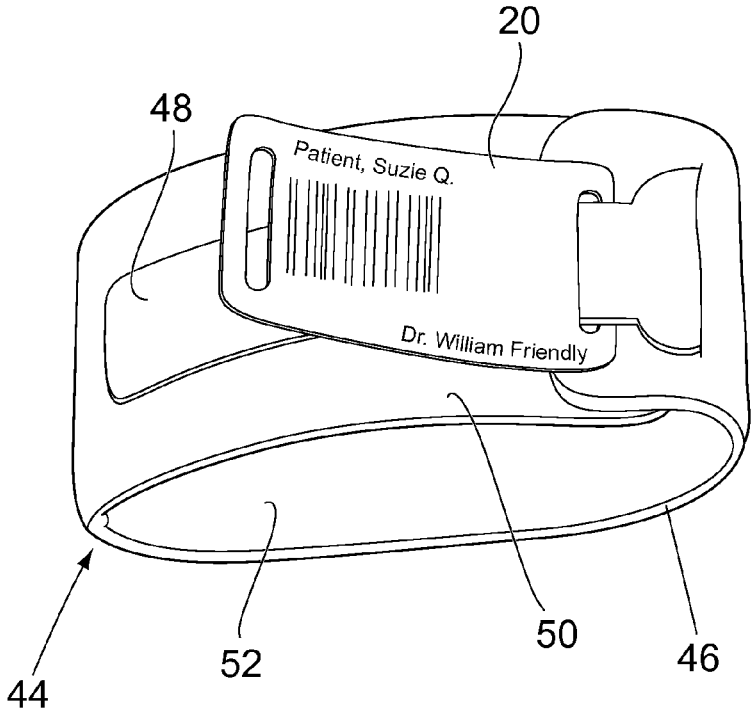
FIG. 6 is a perspective view of an assembled wristband with the strap threaded through one of the cinch slots.

In use, the hang tags in the form of a sheetlet or page sized form are conveniently processed through a laser printer or the like at which time the patient's name or other identifying information is applied to the imaging area. A hang tag may then be separated from the sheetlet or page sized form, and the carrier strap inserted through one or both of the cinch slots. As shown in FIG. 5, the hang tag may be positioned on the strap so that the extra length of the strap extends beyond the outboard cinch slot so that the maximum size "tongue" extends beyond for attachment to the loop material on the back of the carrier. Also, in FIG. 5 the carrier is shown as overlapping so that only the cushion material forming the carrier contacts the patient's skin. This arrangement is similarly shown in FIG. 7. With this arrangement, it is thought that maximum comfort is provided to the patient as the carrier may be "snugged" about the wrist, or ankle, so as not to be tight but to be firmly secured and yet just the cushion material is softly compressed against the skin. A second configuration is shown in FIG. 6, as the strap is threaded through only one of the two cinch slots. Although FIG. 6 shows the strap inserted through the inboard cinch slot, the strap may be similarly inserted through the outboard slot, depending on the choice of the nurse. One or the other of the slots might be chosen to facilitate access to a bar code on one side or the other of the hang tag, for example, or for any other reason including merely personal preference. Again, in FIG. 6 as in FIG. 5, the carrier is shown as overlapping, for maximum comfort. However, the carrier could be arranged to not overlap, for example should a longer length wristband be needed, although that application is not contemplated by the inventor as preferable as it possibly exposes rough edges and surfaces to the patient's skin.

Figure 7:
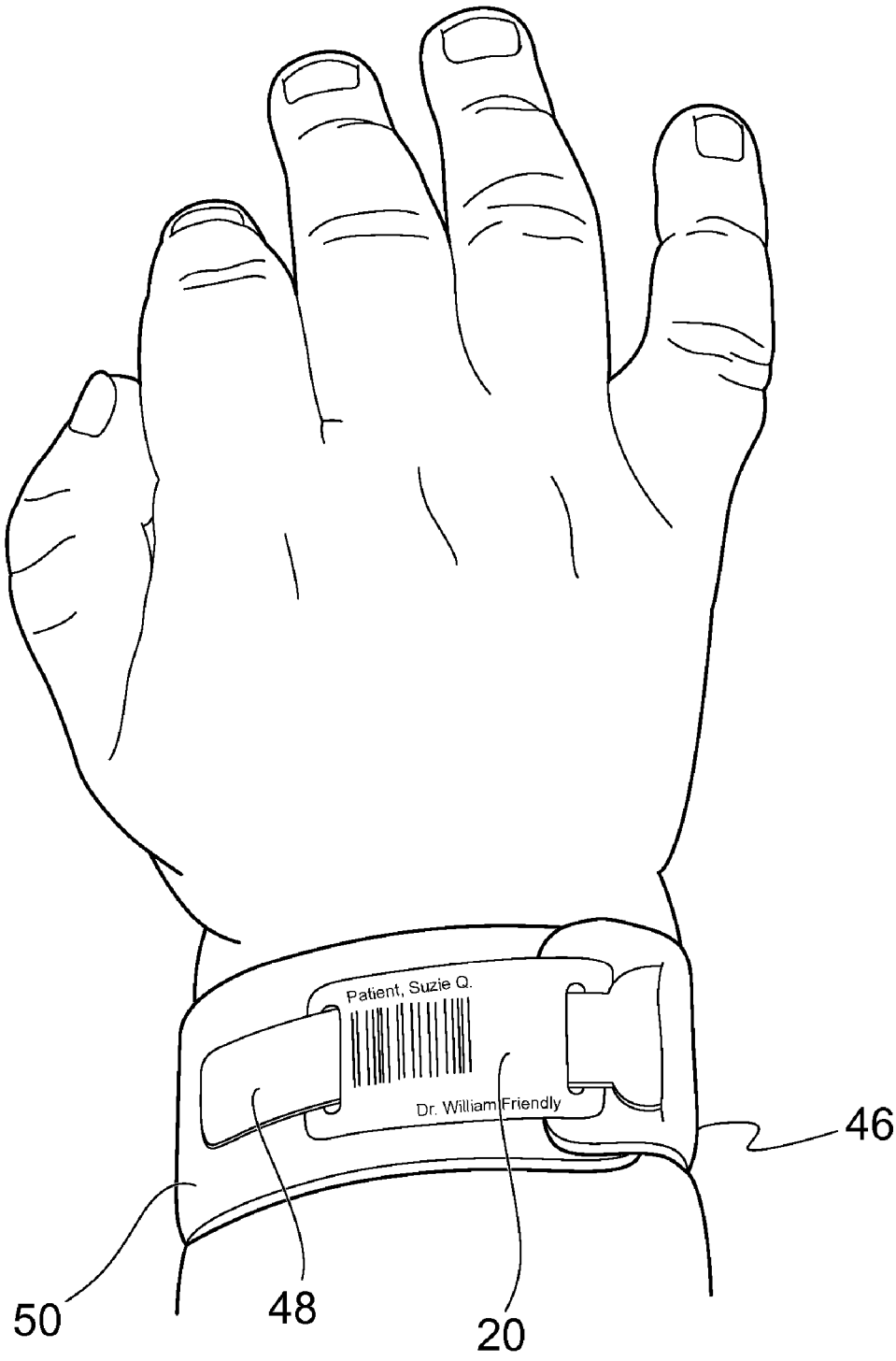
FIG. 7 is a perspective view of an assembled wristband applied to a patient's wrist.

As shown in FIG. 7, the wristband is conveniently arranged to encircle the patient's wrist, and may be "snugged" against the wrist to hold it in place, with the information on the hang tag exposed for ready viewing and access for example to read a bar code imprinted thereon. With this arrangement, the wristband will resist unintentional migration or movement which would obscure the patient information. However, as noted above, the length of the wristband compared to the size of the patient's appendage will in some cases limit the choice for applying the wristband in this overlapping configuration or not. While a short gap between the two ends of the carrier might well be acceptable due to the relative thickness of the carrier, too long a gap would potentially expose the "hook" surface of the strap to the patient's skin as well as shorten the amount of strap hook surface contacting the loop surface which might compromise the integrity of the attachment. Therefore, while the design of the wristband does provide some adjustability, some care must be used in choosing the right size wristband for the particular patient.

The invention has been described in terms of a preferred embodiment as shown in the drawings and described above. However, the invention should not be considered as limited to the specifics of this preferred embodiment as various changes and alternatives to the specific disclosure would be apparent to those of skill in the art and are included within the teaching of the invention. For example, various kinds of materials may be used for the band portion of the carrier, various dimensions and lengths can be chosen as convenient for the various portions of the carrier such as the band and the strap, the strap may be secured to the band portion by any convenient attachment means including a hook-and-loop fastener, snap, etc., the hang tag could be preprinted with information desired to be included, such as special precaution conditions or other warnings or indications relating to the medical condition or treatment of the patient, a cinch slot could be provided on only one side of the hang tag instead of both sides or moved to different areas on the hang tag, a wristband could function as a hang tag by cutting off the strap portion, and other similar changes. Furthermore, although explained as intended for principal use for baby patients, the wristband of the present invention may also be used for any patient for increased comfort and reduced risk of abrasion, rash, or unintentional injury for those patients with skin integrity issues such as burn victims, elderly patients, etc. As such, the present invention should only be considered as limited by the scope of the claims appended hereto and their legal equivalents.

What is claimed is:

1. A wristband comprising a carrier and a printer processible hang tag attached to said carrier, said carrier having a band portion and a strap portion, said strap portion attaching to said band portion to thereby secure the wristband about a wearer's wrist, said band portion having a width larger than the width of the strap portion, said hang tag having a face ply area for receiving a printed image and a pair of slots formed in opposing ends of the hang tag and arranged to position the hang tag and its printed image immediately above the strap to thereby minimally overlap the width of the wristband, said slots each having a length sufficiently large to allow said hang tag to slide freely along the strap portion but not the band portion when attached to the wristband and the wristband is secured to the wearer's wrist, and wherein the band portion is long enough to substantially surround the wearer's wrist as it is secured thereto with the band portion separating the hang tag from the wearer's wrist.

2. The wristband of claim 1 wherein the carrier includes an attachment for joining the strap portion to the band portion to thereby secure the wristband about the wearer's wrist.

3. The wristband of claim 1 wherein said hang tag has a width greater than the strap portion, said slots being sized to allow the hang tag to be brought adjacent to but not pass over the band portion after the wristband is secured to the wearer, with the distance between the slots being less than the length of the band portion.

4. The wristband of claim 3 wherein the hang tag is formed substantially in the shape of a rectangle and the slots are substantially aligned with opposing sides of said rectangle so that as the strap portion is inserted through both of said slots the hang tag is oriented to be substantially aligned with the strap portion.

5. The wristband of claim 4 wherein the slots are spaced from each other and substantially adjacent the opposing sides of the hang tag so as to provide space therebetween to display wearer information imaged on said hang tag face ply area.

6. A wristband comprising a band for encircling a wearer's wrist and a strap for attaching the wristband in a circle to maintain it about the wearer's wrist, and a generally rectangular shaped, printer processible hang tag for receiving a printed image having two slots formed at opposing sides of a longest length of said hang tag and arranged to position the hang tag and its printed image immediately above the strap to thereby minimally overlap the width of the wristband and through which said wristband is inserted to thereby capture the hang tag and maintain it on the wristband after the wristband is attached, each of said slots being longer than the width of the strap but narrower than the width of the band so that the hang tag may freely slide on said strap portion and does not slide over the band after the wristband is secured to the wearer's wrist, wherein the band portion is long enough to substantially surround the wearer's wrist as it is secured thereto with the band portion separating the hang tag from the wearer's wrist.

7. The wristband of claim 6 wherein the hang tag is formed at least partly of a sheet-type material and the wristband is separately formed at least partly from a material having a thickness in excess of the thickness of the hang tag.

8. The wristband of claim 7 wherein the hang tag is separable from a sheet containing a plurality of said hang tags, and the wristband is not formed as part of a business form.

9. The wristband of claim 8 wherein said band is wider than the strap, and remains wider than the strap after the wristband is secured to the wearer's wrist.

10. The wristband of claim 6 wherein each of said wristband and hang tag are defined by die cuts in a multi-ply carrier page.

11. A wristband/hang tag assembly, said wristband/hang tag assembly comprising a wristband with a body portion of larger width than a strap portion, said strap portion extending from one side of the body portion and being configured to attach to the body portion to thereby secure the wristband about a wearer's wrist, the wristband being at least partially made from a plastic material, the hang tag having an area for receiving a printed image and being printer processible and formed of a sheet-like material and having a pair of opposing slots and arranged to position the hang tag and its printed image immediately above the strap to thereby minimally overlap the width of the wristband, said slots also being sized to slide over the strap portion but not the body portion both before and after the wristband is applied to a wearer, and said slots being spaced apart to define the image receiving area therebetween so that the hang tag may be secured to the strap portion at both its sides by passing the strap portion through the opposing slots as the wristband is applied to said wearer, wherein the body portion is long enough to substantially surround the wearer's wrist as it is secured thereto with the body portion separating the hang tag from the wearer's wrist as the wristband is secured to the wearer's wrist.

12. The wristband/hang tag combination of claim 11 wherein said hang tag has a length shorter than the body portion.

13. The wristband/hang tag combination of claim 12 wherein said wristband includes a mechanical attachment for attaching the strap portion to thereby secure the wristband/hang tag combination about the wearer's wrist.

14. The wristband/hang tag combination of claim 13 wherein said mechanical attachment comprises one element thereof extending along the length of the strap portion so that the strap portion may be secured to the wristband at different locations along its length.

15. The wristband/hang tag combination of claim 11 wherein the distance between the hang tag slots is shorter than the length of the body portion.

16. The wristband/hang tag combination of claim 11 wherein the body portion is longer than the strap portion.

17. The wristband/hang tag combination of claim 11 further comprising a mechanical attachment for attaching the strap portion to the body portion and thereby securing the wristband/hang tag combination about the wearer's wrist, said mechanical attachment comprising one of a hook or loop material applied to the body portion and the other of the hook or loop material applied to the strap portion so that as the strap portion is wrapped about the body portion the strap portion may be pressed against the body portion to bring the hook and loop material in contact with each other and thereby secure the wristband/hang tag in place.

* * * * *